United States Patent [19]

Aarstad

[11] Patent Number: 4,747,242

[45] Date of Patent: May 31, 1988

[54] TWO LEVEL STRUCTURE FOR PARKING VEHICLES OR STORING GOODS

[75] Inventor: Einar Aarstad, Lysaker, Norway

[73] Assignee: Up and Down Garage System A/S, Stabekk, Norway

[21] Appl. No.: 872,653

[22] Filed: Jun. 10, 1986

[30] Foreign Application Priority Data

Jul. 1, 1985 [GB] United Kingdom ..... 8516564

[51] Int. Cl.[4] ..... E01F 9/00

[52] U.S. Cl. ..... 52/174; 52/169.6; 187/8.47; 187/8.62; 414/227; 414/233

[58] Field of Search ..... 52/169.9, 169.7, 174, 52/67, 175; 187/8.47, 8.62, 8.41; 414/227, 223

[56] References Cited

U.S. PATENT DOCUMENTS

| | | | |
|---|---|---|---|
| 3,276,548 | 10/1966 | Woor et al. | 187/8.47 |
| 3,520,423 | 7/1970 | Gerhardt . | |
| 3,858,371 | 1/1975 | Averill | 52/169.6 X |
| 4,545,523 | 10/1985 | Galbreath et al. | 49/483 X |

FOREIGN PATENT DOCUMENTS

| | | | |
|---|---|---|---|
| 1166991 | 4/1964 | Fed. Rep. of Germany | 187/8.47 |
| 3012610 | 10/1981 | Fed. Rep. of Germany . | |
| 3149971 | 6/1983 | Fed. Rep. of Germany | 52/174 |
| 1486602 | 6/1967 | France | 52/169.6 |
| 2,253,902 | 7/1975 | France . | |
| 2388107 | 11/1978 | France . | |
| 454428 | 6/1968 | Switzerland | 52/169.9 |

*Primary Examiner*—Carl D. Friedman

*Attorney, Agent, or Firm*—Roylance, Abrams, Berdo & Goodman

[57] ABSTRACT

A two level structure for parking vehicles or storing goods, which structure comprises a sunken pit, first and second spaced apart platform members which are for receiving the vehicles or the goods, support means which is mounted on the first platform member and which supports the second platform member in a fixed horizontal position above the first platform member, mover means for moving the platform members from a first position in which the platform member is in the pit and the second platform member is at ground level to a second position in which the first platform member is at ground level and the second platform member is above ground level, a water sealing arrangement for preventing the ingress of water into the pit, and emergency stop means for automatically stopping the descent of the first and second platform members in the event that the second platform member encounters an obstacle, the second platform member being such that it has a peripheral overlap portion which overlaps the rim of the pit, and the water sealing arrangement and the emergency stop means being so positioned as to operate over the part of the ground that is overlapped by the peripheral overlap portion of the second platform member.

5 Claims, 6 Drawing Sheets

TWO LEVEL STRUCTURE FOR PARKING VEHICLES OR STORING GOODS

This invention relates to a two level structure for parking vehicles or storing goods.

The parking of vehicles is becoming something of an ever increasing problem. Many private households currently own two or even three vehicles and there is often insufficient parking space in the garage or drive of the house to accommodate these vehicles. Parking on the road is not always possible or convenient. Even vehicle fleet owners such for example as bus companies often find that their vehicle parking space is inadequate or that the parking space occupied by their vehicles could be better occupied for some other purpose. Similar problems are often encountered by the police, self-defence and military forces in parking their vehicles.

There have been many previous attempts to reduce the above mentioned problem by providing a two level parking structure. The majority of the known two level parking structures are complex, which may account for the fact that they have not been constructed and put into every day use. Some of the known two level parking structures are such that the top platform pivots with respect to the bottom platform and the entire arrangement for moving the platforms up and down then becomes complicated.

In addition to being able to provide a two level structure that overcomes the above mentioned problem and which is not too complex in construction, it would be a further advantage if the two level structure could act as a basic bomb shelter. The bomb shelter need not be a sophisticated arrangement and it need only be sufficient to give basic protection. Such basic protection, would however be an advantageous feature not offered by many known two level parking structures.

It is an aim of the present invention to reduce the above mentioned problem by providing a two level structure which is of relatively simple construction and which can also be used as a bomb shelter.

Accordingly, this invention provides a two level structure for parking vehicles or storing goods, which structure comprises a sunken pit, first and second spaced apart platfrom members which are for receiving the vehicles or the goods, support means which is mounted on the first platform member and which supports the second platform member in a fixed horizontal position above the first platform member, mover means for moving the platform members from a first position in which the first platform member is in the pit and the second platform member is at ground level to a second position in which the first platform member is at ground level and the second platform member is above ground level, a water sealing arrangement for preventing the ingress of water into the pit, and emergency stop means for automatically stopping the descent of the first and the second platform members in the event that the second platfrom member encounters an obstacle, the second platform member being such that it has a peripheral overlap portion which overlaps the rim of the pit, the water sealing arrangement and the emergency stop means being so positioned as to operate over that part of the ground that is overlapped by the peripheral overlap portion of the second platform member, the peripheral overlap portion being such that it extends from the second platform member and is strong enough to withstand the weight of vehicles being parked running over it.

It will be apparent that when the first platform member is at ground level, a vehicle can be driven on to it and then the first platform member can be caused to descend into the pit so that the second platform member is then at ground level and is then available for receiving another vehicle to be parked. Such an arrangement is simple yet effective and there is no need to tilt the second platform member with respect to the first platform member. If the structure of the invention is installed in a driveway to a house, then the second platform member will effectively form part of the driveway when it is at ground level. For fleet vehicle owners and the like, structures of the invention can be installed in rows or other desired positions in vehicle parks effectively to double the parking space of the vehicle parks. Obviously, if desired, goods can be stored on the first or the second platform members instead of parking vehicles on the first and the second platform members. As will be readily appreciated, goods stored on the first platform member when it is down in the pit are effectively very securely stored and thus the two level structure of the present invention provides a good security facility for storing goods. Any type of goods may be stored, for example building materials or spare parts for vehicles.

Although not specifically designed as a permanent bomb shelter, it will be appreciated that the two level structure may serve as a temporary bomb shelter if desired, thereby giving the owners of the two level structure some peace of mind that they will have somewhere to go in the event of bombs being dropped. It is of course necessary to ensure that the walls and the ceiling of the two level structure are of an appropriate thickness if the two level structure is also to be installed with the extra purpose in mind of serving as a temporary bomb shelter.

The two level structure may afford basic protection from a bomb blast and it is envisaged that the two level structure should only be occupied for relatively short periods of time. Owners of the two level structures will thus have greater protection than having no bomb shelter at all and this will given them the above mentioned peace of mind. The double use of the two level structure of the invention is such that it will normally be used for parking vehicles or storing goods, but it will also be available for use as a bomb shelter should the need arise.

The water sealing arrangement comprises an elongate seal provided on the overlap portion of the second platform member, and a complementary elongate seal provided on the ground around the rim of the pit, the two seals being arranged to be in water-sealing cooperating registry when the second platform member is at ground level.

The emergency stop means comprises an elongate pressure-responsive switch arrangement. The elongate pressure-responsive switch arrangement comprises a spring biased electrical contact member which normally locates in a channel and which operates to activate the emergency stop means if it is prevented by the obstacle from normally locating in the channel.

If desired, an electronic detection system, for example of a known construction, may be used to activate the emergency stop means. The electronic detection system may be located underneath the peripheral overlap portion of the second platform member, or it may be located elsewhere on the second platform member. The electronic detection system may be linked to a similar system located at ground level around the outside lip of the sunken pit. It will be appreciated that any interruption of the electronic beam, for example by a protruding part of a vehicle, a vehicle load or a person, will automatically result in activation of the emergency stop means.

The two level structure includes a water drainage arrangement for draining water from the bottom of the pit. The water sealing arrangement will be effective to stop surface water running off the ground and into the pit, but water dripping from underneath the vehicle will of course still drip into the pit. The water on the vehicle may be from rain or it may be from snow or ice thawing out.

The water dripping from underneath the vehicle may advantageously be arranged to run into a sloping channel extending along the floor of the sunken pit and running the length of the sunken pit. The water in the channel may then run into a hole located at one end of the channel. The hole may be located, for example, just before a main end wall.

Preferably, the two level structure includes a pump for pumping the collected water out of the pit and away from the two level structure. The pump may be located in a wall of the pit. The pump may pump the liquid through a tube to a container which is above ground. Alternatively, the pump may pump the liquid through a tube to be just run off above ground at a desired position. The pump may be mains and/or battery operated.

The two level structure preferably includes a ventilation system. The ventilation system may be for continuously recycling air and for assisting in drying moisture inside the pit and on the first platform member.

The ventilation system may include filter means for filtering the air. The type of filter means employed will obviously depend upon the impurities to be removed from the air.

The ventilation system may be such that the sunken pit is provided with two openings in a side or an end wall, one of the openings being located near the bottom of the pit in order to remove dense air impurities, and the other opening being located towards the top of the pit in order to remove lighter impurities. Both openings will enable the ventilation system to recycle the air. Advantageously, both openings may be connected to the same ventilation shaft.

Wehre one or more ventilation shafts are employed, the or each ventilation shaft may contain a blast protection valve, a gas filter, a fan or fans with electric motors, and a flexible hose with a rubber collar and the tube clips.

The ventilation system may be such that ordinary air impurities will continuously be removed from the pit under normal circumstances but the ventilation system may also be such that it can provide an air filter system capable of purifying outside air which may be soiled during a bomb blast. In this latter case, the purified air can be circulated through the pit. Thus the ventilation system may be a dual air filtering ventilation system which can remove air impurities from the two level structure/sunken pit and/or cleanse outside air and provide the two level structure/sunken pit with the pure air.

The two level structure may include ramp members positioned around the edge of the second platform member. Preferably, the ramp members are pivotable with respect to the second platform member.

The first platform member may be so constructed as to allow access to the bottom of the pit beneath the first platform member.

The first platform member is provided with an access hatch.

Preferably, the first and the second platform members are plates. Other constructions for the platform members may however be employed. When the platform members are plates, they may be made of steel or other material which is sufficiently thick that reinforcing struts are not required. By way of example, it is mentioned that steel plates of about 10 cm thick can advantageously be employed to support the weight of most vehicles such for example as cars, buses, lorries, jeeps and tanks. Obviously, if the metal from which the plates are made is somewhat thin for the intended vehicles or goods to be supported, then the underside of the plates may be reinforced with reinforcing struts.

The mover means may be hydraulic, pneumatic or electrically operated mover means.

The mover means may be a piston and cylinder arrangement, or a scissor jack arrangement.

It is presently preferred that the mover means be hydraulically operated since the use of hydraulics enables the generation of the considerable force required for raising and lowering heavy weights on the platform members.

The pit may have reinforced walls and a reinforced floor. The walls and/or the floor of the pit may be made of a prefabricated material. Alternatively, the walls and/or the floor of the pit can be made in situ.

The two level structure may be fabricated such that it has a housing for going into the sunken pit, which housing is either U-shape in cross section or is such that the side walls are straight and meet the floor of the housing at right angles. The U-shape is preferred as it gives a unique design having good strength capabalities.

The housing may be produced in any desired material. Where metals are employed, then a presently preferred metal is aluminium. Aluminium can give the required strength characteristics whilst still being relatively light. Obviously, various other materials may be chosen as may be desired and to suit various geographical locations.

The two level structure inside the pit may have walls which contain recessed areas for providing one or more storage areas for hanging equipment such for example as mechanical equipment, tyres, tools and other items which are normally found in above ground garages. With the equipment in these recessed areas, space will not be taken up but, at the same time, the equipment will be readily available to persons working in the pit on a vehicle or on another object.

The two level structure may include illumination means.

Several outlets for the illumination means may be provided in order to create adequate lighting on and around any vehicle or other goods stored in the two level structure. The adequate lighting is designed to enable work to be carried out on a vehicle or other object when it is in the pit. The lighting should also enable the first platform member to be fully illuminated when it is in the raised position parallel to the ground, thereby making it easier for a vehicle owner to drive on and off the first platform member when it is dark.

The illumination means may be battery and/or mains operated. Preferably, the illumination means is such that in the event of a mains power failure, the illumination means can still be operated by the battery.

The illumination means may be arranged to remain illuminated for a period of time after the first platform member has descended into the pit. This is advantageous in order to help to prevent accidents should a person be unwittingly left in a vehicle during the descent into the pit. The person would then be able to see.

The two level structure may include alarm means. The alarm means may then be used for emergency situations, such for example as the above mentioned situation where a person is unwittingly left in a vehicle during its descent into the pit.

The alarm means may be audio alarm means and/or visual alarm means. The alarm means may be push button operated.

The two level structure may include an emergency manually-operated device for at least moving the first platform member from its position down in the pit to its position at ground level.

The emergency manually-operated device may also be capable of moving the first platform member from its position at ground level to its position down in the pit. The emergency manually-operated device will usually be associated with the mover means to effect a manual operation of the mover means. However, if desired, the emergency manually-operated device may be associated with a separate emergency moving arrangement for moving the first and the second platform members as mentioned above.

The two level structure may include control means positioned above ground level for causing desired operation of the mover means to raise or lower the platform members.

The control means may be mounted on a post positioned adjacent the pit. The control means may be actuated by a key, a card, a push button or by an electronic signal from a remote electronic signalling device.

The support means employed in the two level structure may be of any desired shape or construction. The support means should be designed securely to support the second platform member above the first platform member whilst, at the same time, preferably not occupying too much space. The support means may comprise four pillars positioned one towards each corner of the first platform member. Bracing members may be employed where necessary or desirable.

Advantageously, the two level structure is provided with a recess in a side wall of the pit so that a person can escape into the recess in the event that a person should be working in the pit underneath the first platform member, for example effecting a cleaning operation, and the first platform member should start to descend. The recess in the pit will usually be in one of the side walls of the pit.

The two level structure may be provided with a heating system. The heating system may be located in the pit near a main end wall or, alternatively, along a side wall of the pit. The heating system may be mains and/or battery operated. The heating system will be for providing adequate heat to warm the environment when the first platform member is located down in the pit and when it is desired to maintain a vehicle or stored goods at a predetermined relatively warm temperature during cold winter periods. The heating system may include a thermostat to control the temperature as may be required. The heating system may be effective to also assist in thawing out ice or snow that may have accumulated on a vehicle. Also, the heating system may be effective to facilitate easier starting of the vehicle after an overnight period or a prolonged storage period. The heating system may be arranged to come on and off automatically.

An end or a side wall in the sunken pit may be provided with a series of electrical sockets for receiving plugs of appropriate electrical equipment required by vehicle owners when working on their vehicles or on other stored goods in the two level structure. Thus the equipment may be that required for engine maintenance or for changing wheel nuts.

An electrical socket may be provided for containing a plug of an engine warming device for warming the engine of the vehicle in order to keep the oil in the engine at a constant overnight temperature. This is for facilitating easier starting in the mornings in cold winters. Such engine warming devices are well known throughout the Scandanavian countries and they are utilised in most above ground garages.

All the operating instruments required by the two level structure may be situated in an end wall of the sunken pit. The instruments may include a mains switch for controlling the illumination means, an emergency battery pack for automatically taking over the electrical functions in the case of a mains failure, the ventilation system for recycling the air, the emergency alarm means, the heating system, the sockets for the use of equipment in motor maintenance as mentioned above, and the plug for the engine warming device.

Advantageously, the housing of the two level structure that is to go into the sunken pit may be completely preconstructed in a moulded shell form. This is easily set into a pre-dug pit and it requires only mains connection before it is operating functionally. Furthermore, it is easily removed in the event of an owner wishing to expand any above ground structure which may be nearby, or to change any vehicle approachways. The moulded shell structure may be removed and placed in a new position or it may be entirely removed and resold as a used unit. This gives good flexibility of positioning and use.

If desired, a second moulded shell storage module of a similar shape to the above mentioned moulded shell may be connected to the main two level structure by a simple clip-on system. The second storage module will not have access through the roof or ceiling but through a hatch door, for example located in one end, which leads into the main sunken pit of the two level structure. The second storage module may be used for storing mechanical and vehicle components such as are usually stored in an above ground garage. The second storage module may also contain folded bunk beds along the walls, a toilet, a wash room, a hatch door and a water storage tank. Such facilities may be required by appropriate authorities in order that the two level structure also qualifies as a bomb shelter. The second storage module may have thicker walls and ceilings in order to withstand most bomb explosions, whilst still serving its main purpose as an annex to the pit of the two level structure.

Embodiments of the invention will now be described solely by way of example and with reference to the accompanying drawings in which.

Figure 1:
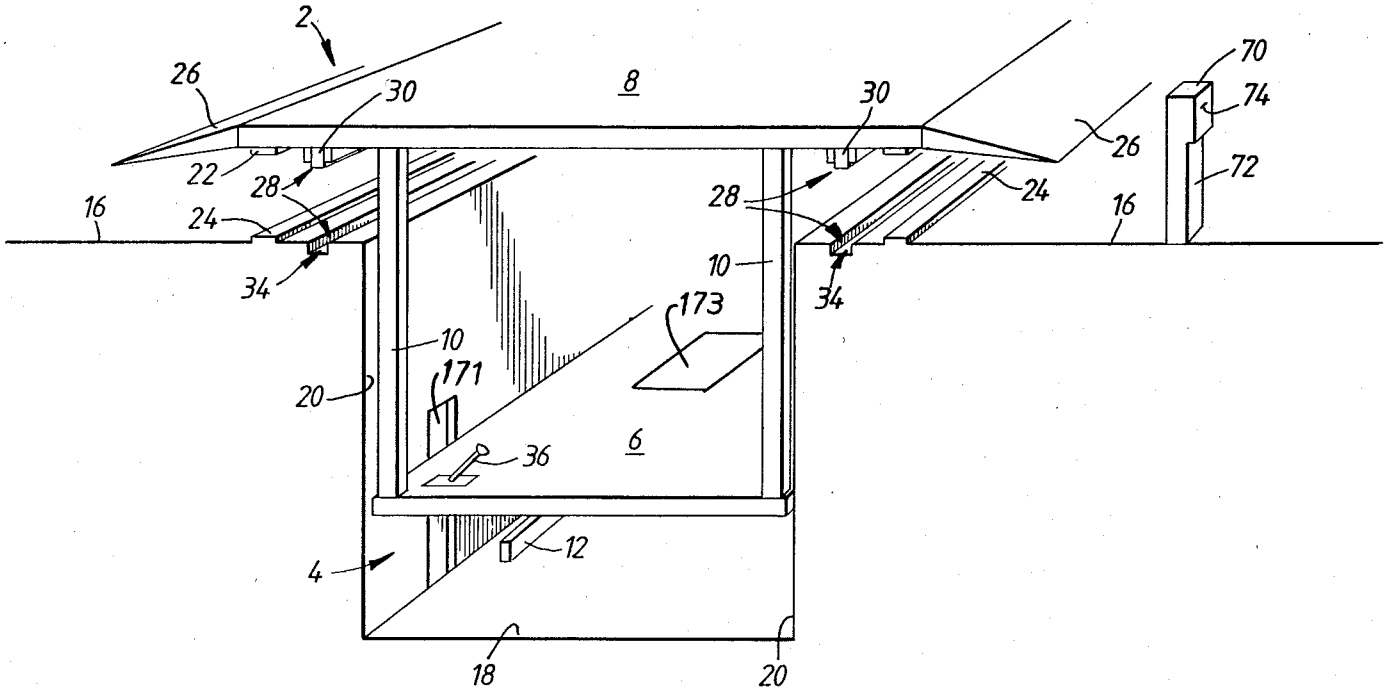
FIG. 1 is a perspective view of the front part of a first two level structure in a partially lowered position.
Figure 2:
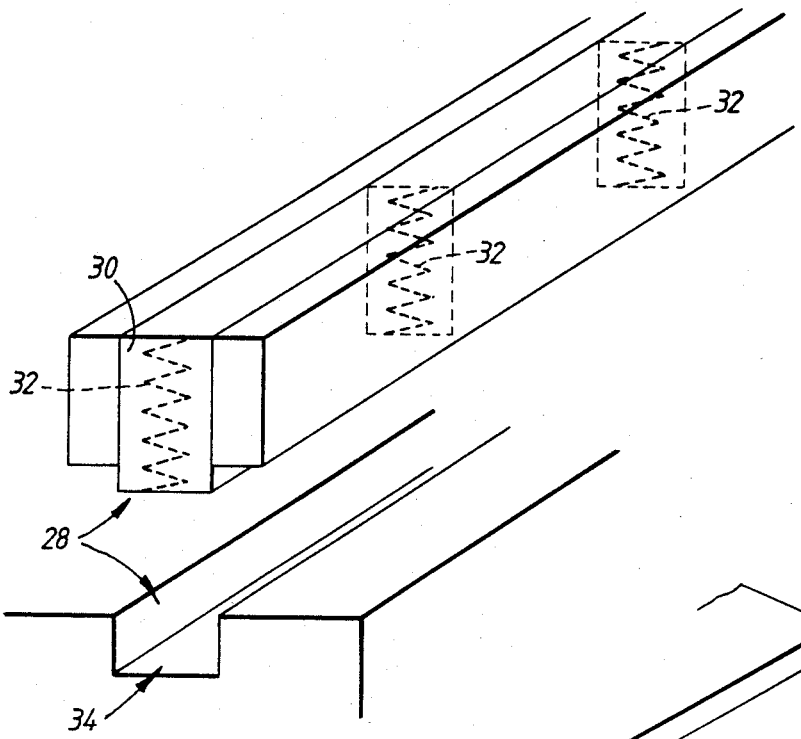
FIG. 2 shows in detail the emergency stop means used in the two level structure of FIG. 1.
Figure 3:
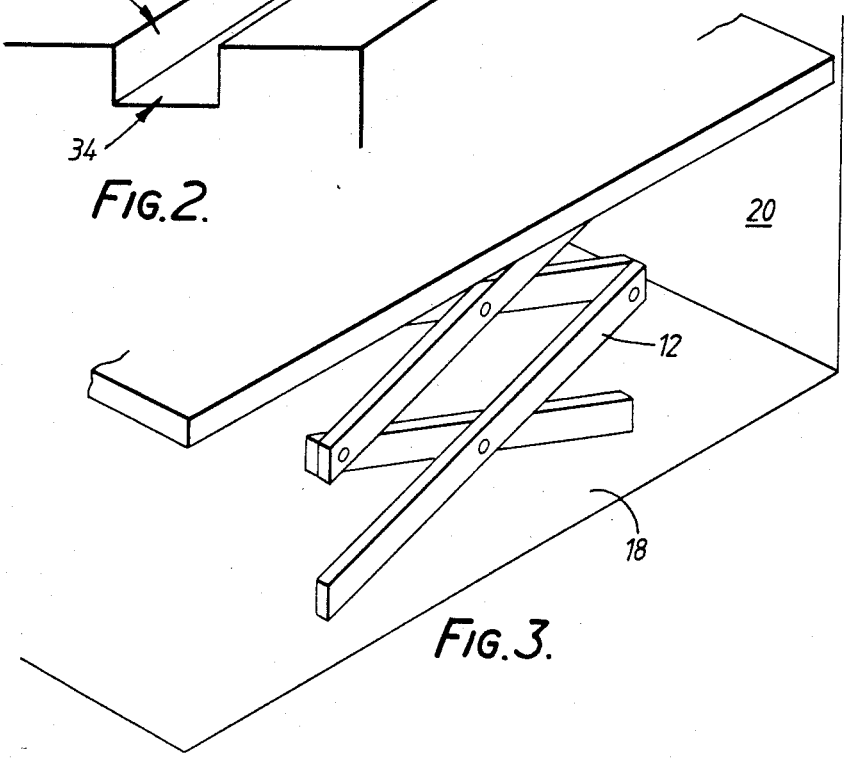
FIG. 3 shows in detail one of the jacks used in the two level structure of FIG. 1.

Referring to FIGS. 1 to 4, there is shown a two level structure 2 for parking vehicles (not shown) or for storing goods (not shown). The structure 2 comprises a sunken pit 4, a first platform member 6 and a second platform member 8. The second platform member 8 is mounted in spaced apart fixed relationship to the first platform member 6 by support means including upright pillars 10. As can be seen, the pillars 10 are supported on the first platform member 6 and they support the second platform member 8 in a fixed horizontal position above the first platform member 6. The second platform member 8 is thus not able to pivot with respect to the first platform member 6.

The two level structure 2 comprises mover means in the form of a pair of scissor jacks 12,14 for moving the platform members 6,8 from a first position in which the first platform member 6 is in the pit 4 and the second platform member 8 is at ground level 16, to a second position in which the first platform member 6 is at ground level 16 and the second platform member 8 is above ground level 16. It will be seen that the jacks 12,14 rest on the bottom 18 of the pit 4 and that they press on the undersurface of the first platfrom member 6. Usually, the jacks 12,14 will be arranged to be hydraulically operated, but they may be pneumatically or electrically operated if desired.

The two level structure 2 is such that the bottom 18 and the walls 20 of the pit 4 are preferably made of a prefabricated material. The first and second platform members 6,8 are preferably steel or other metal plates, and the pillars 10 are also preferably made of steel or other metal.

The two level structure 2 is provided with a water sealing arrangement comprising an elongate seal 22 provided on the underside of the second platform member 8, and a complementary elongate seal 24 provided around the rim of the pit 4. The two seals 22,24 are arranged to be in water-sealing cooperating registry when the second platform member 8 is at ground level. Thus surface water on the ground cannot run off the ground and into the pit 4. In this connection, it is to be mentioned that the seal 24 upstands from the ground level 16 and thus provides a barrier to water running over the ground even when the platform members 6,8 are in their second position in which the first platform member 6 is at ground level 16 and the second platform member 8 is above ground level 16.

The second platform member 8 is provided with pivotable ramp members 26 around its four sides. The ramp members 26 may act to give very easy access to the upper surface of the second platform member 8.

The two level structure 2 includes emergency stop means for automatically stopping the descent of the platform members 6,8 in the event of an emergency such for example as a person's foot being positioned underneath one of the ramp members 26 such that it would be crushed if the second platform member 8 were to be lowered to ground level. The emergency stop means comprises an elongate pressure-responsive switch arrangement 28. The switch arrangement 28 is provided around all four sides of the pit 4. The switch arrangement 28 comprises a spring biased electrical contact member 30 which is biased by a plurality of spaced apart springs 32. The electrical contact member 32 normally locates in a channel 34 provided in the ground as illustrated. If an obstacle is located in or over the channel 34, it will be apparent that the electrical contact member 30 will not be able to normally freely locate in the channel 34 and the obstacle will push the electrical contact member upwardly against the pressure of the springs 32. An appropriate circuit can then be made or broken which will cause the emergency stop means to operate to stop any further downward descent of the first and second platform members 6,8. Thus, the first and second platform members will be stopped substantially directly the obstacle engages the electrical contact member 30.

Preferably, the emergency stop means is such that the descent of the platform members 6,8 cannot recommence until the obstacle which caused the stoppage has been removed. The emergency stop means are preferably arranged to be operated either from the mains or from a battery.

As shown in FIG. 1, the two level structure 2 includes an emergency manually operated device in the form of a push/pull lever 36 for moving the first platform member 6 from its position down in the pit 4 to its position at ground level 16, and for moving the first platform member 6 from its position at ground level 16 to its position down in the pit 4. The lever 36 is operatively associated with the jacks 12,14 so that a reciprocating movement of the lever 36 is effective manually to operate the jacks 12,14, the jacks 12,14 normally being operated hydraulically.

Figure 4:
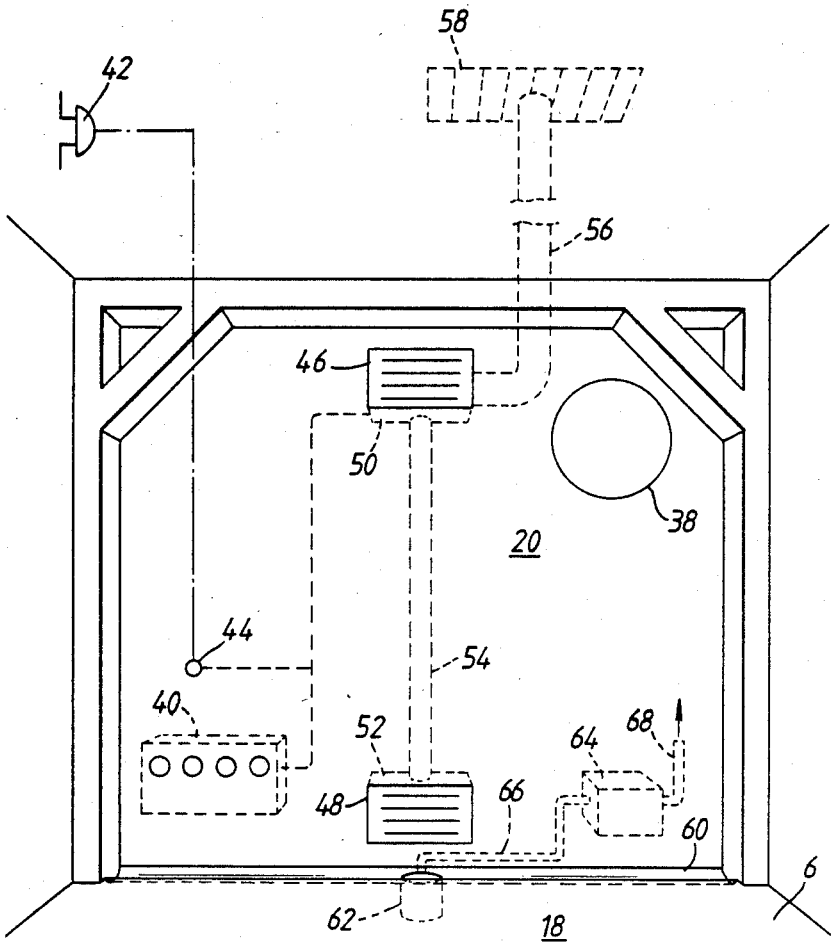
FIG. 4 shows the rear wall of the pit used in the two level structure of FIG. 1.

As shown in FIG. 4, the two level structure 2 is provided with illumination means in the form of a circular light 38 positioned in an end wall 20 of the pit 4. The light 38 is such that it can be operated either by the mains or by a battery. The light 38 is thus usually operated by mains electricity but, in the event of a mains failure, the light 38 can still be operated by means of the battery. The battery is advantageously a rechargeable battery 40. The light 38 is also arranged to remain illuminated for a predetermined period of time after the first platform member 6 has descended into the pit 4.

Also as shown in FIG. 4, the two level structure 2 includes audio alarm means in the form of a bell 42 which is positioned above ground level 16. The bell 42 is actuated by means of a push button 44 located in the same end wall 20 that has the light 38.

The end wall 20 containing the light 38 and the push button 44 is also provided with an upper ventilation grill 46 and a lower ventilation grill 48. The upper ventilation grill 46 is for sucking out fumes from the top of the pit 4, whilst the bottom ventilation grill 48 is for sucking out more dense fumes that may have descended to the bottom of the pit 4. The two grills 46,48 can each be provided with suction apparatus 50,52 as illustrated. The two pieces of suction apparatus 50,52 are connected by a connecting pipe 54. Fumes, gases and other bad air removed from the pit 4 can pass along a conduit 56 to an outlet grill 58 located at ground level 16. In the event that the two level structure 2 is to be used as a bomb shelter, then for prolonged periods of occupation, the operation of the devices 50,52 may be reversed such that they suck air in through the grill 58 rather than blow it out. In this case, the sucked air will pass along the conduit 56 and can be blown out through the ventilation grills 46,48, preferably after having passed through appropriate filter means for filtering out desired impurities.

It will be seen that the floor 18 adjacent the end wall 20 as shown in FIG. 4 is provided with a water drainage arrangement in the form of a gully 60 for draining water from the bottom of the pit 4. This water may be snow or ice dripping off the underneath of a vehicle positioned on the first platform member 6. The gully 60 preferably slopes towards its centre so that the water in the gully 60 can drain into a reservoir 62. Preferably, a pump 64 is provided for sucking water from the reservoir 62 along a conduit 66 and up a further conduit 68 out of the pit 4 and away from the two level structure 2.

The two level structure 2 is operated by control means 70 positioned at the top of a post 72 at ground level 16 as shown in FIG. 1. The control means 70 is for causing desired operation of the jacks 12,14 to raise or lower the platform members 6,8. The control means 70 is provided with a slit 74 for receiving a card. Thus, good security is achieved because the control means 70 can only be operated by a correct card being inserted in the slit 74. The post 72 is mounted in the vicinity of the pit 4 as shown, and preferably suitable for access by a driver of a vehicle without the driver of the vehicle having to get out of the vehicle in order to insert the card in the slit 74.

The two level structure 2 can be made of any desired size and strength appropriate to the size and weight of vehicle or goods to be stored on the two level structure 2. The two level structure 2 can be custom built to any desired size to suit not only vehicles or goods to be stored but also the available space, for example in a driveway to a house. If desired, several of the two layer structures 2 can be mounted side by side and/or end to end to create a matrix of two level structures 2 for use with multiple parking or multiple storage requirements. At any time that the two level structure 2 is to act as a bomb shelter, then it is only necessary to remove any vehicle or goods stored on the first platform member 6 and to lower the first platform member 6 to the bottom 18 of the pit 4. This can be done manually by means of the lever 36 or, if desired, an operating means like the operating means 70 can be provided inside the pit 4 where it can be reached by persons standing on the first platform member 6.

Figure 5:
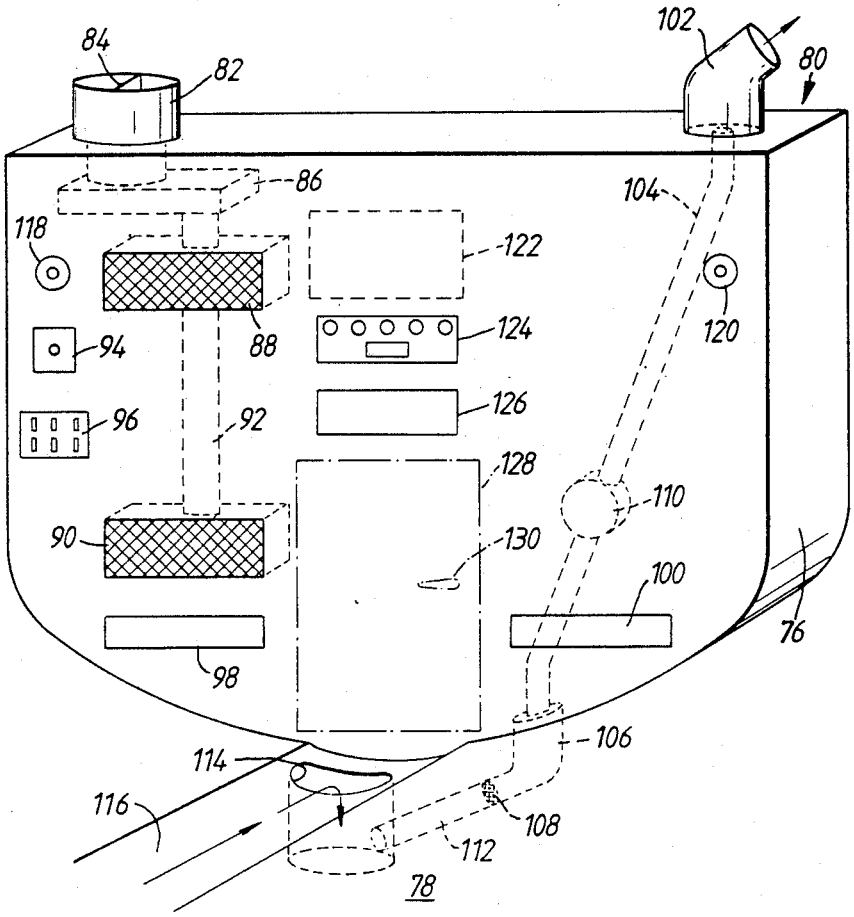
FIG. 5 shows an end wall and part of the floor of part of a second two level structure in accordance with the invention.

Referring now to FIG. 5, there is shown an end wall 76 and part of the floor 78 of a second two level structure 80. The end wall 76 is provided with a ventilation shaft 82 having a divider 84 so that the ventilation shaft 82 with its divider 84 is able to serve as a combined inlet and outlet. The ventilation shaft 82 is associated with a filter device 86 which is itself connected to upper and lower air vents 88,90 respectively. The upper and lower air vents 88,90 are connected to each other by a pipe 92.

Also provided in the end wall 76 are an emergency button 94, a light switch 96 and a pair of heaters 98,100.

At the top of the end wall 76 is provided an outlet conduit 102 which serves as an outlet for water or any other liquid that may be in the bottom of the sunken pit having the end wall 76 and the floor 78. The outlet conduit 102 is connected by a pipe 104 to an elbow tube 106. The elbow tube 106 is provided with a filter 108 for filtering the water as it passes through the elbow tube 106 and along the pipe 104 to the outlet conduit 102. The water is raised to the outlet conduit 102 by means of a pump 110. The water passes to the elbow tube 106 via a pipe 112 and the pipe 112 comes from a hole 114 formed in the floor 78. The floor 78 is provided with a gutter 116 which slopes towards the hole 114.

The end wall 76 is provided with a pair of lights 118,120 for giving good illumination in the sunken pit. Also provided on the end wall 76 are an emergency battery backup system 122, a device 124 having electric sockets as shown and also a connection for receiving an engine warming device (not shown), and a master control panel 126. The master control panel may be computer operated but the master control panel 126 should be such that it will advantageously operate from the emergency battery backup system 122 so that the various pieces of apparatus illustrated in FIG. 5 can still operate in the event of a mains power failure.

If desired, the end wall 76 may be provided with a hatch door 128 having a handle 130. The hatch door 128, when provided, will lead to an auxiliary chamber (not shown) which may be like the sunken pit of the two level structure 80 or which may be provided with equipment needed for enabling the auxiliary chamber to serve as a bomb shelter. Thus, the auxiliary chamber may be provided with beds, water, light, toilet and washing facilities.

It will be noted that the end wall 76 is U-shaped and the entire sunken pit is of this U-shape. The U-shape can be defined by an appropriate housing which may be made in precast metal such for example as aluminium or which may be made in other materials, for example steel reinforced concrete.

Figure 6:
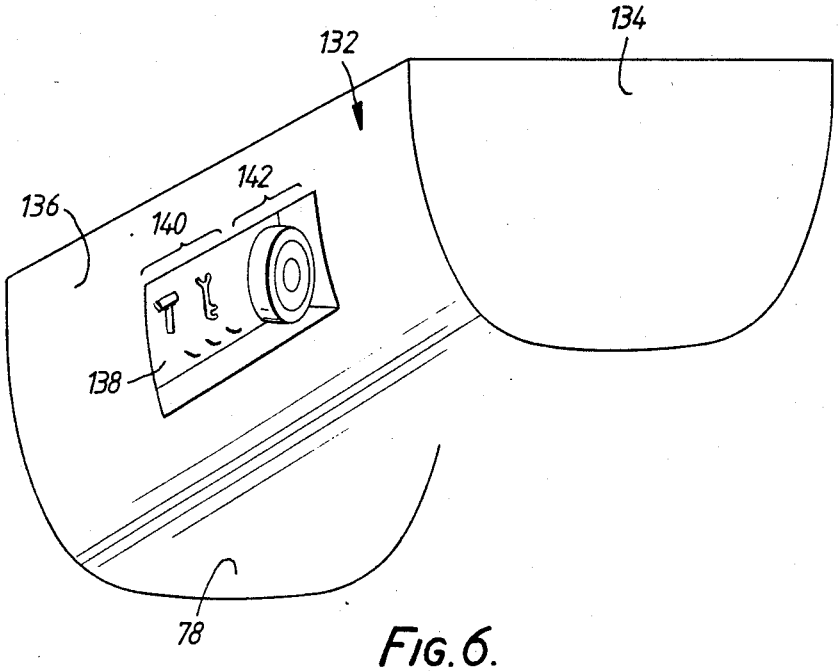
FIG. 6 shows a recess for tools and other equipment in a wall of the second two level structure shown in FIG. 5.

Referring now to FIG. 6, there is shown a U-shaped chamber 132 having the floor 78. The end wall 76 is not shown for clarity. The other end of the chamber 132 is shown provided with an end wall 134 and FIG. 6 illustrates the U-shape of the chamber 132. A side wall 136 is provided with a recessed portion 138 for receiving tools 140 and spare vehicle equipment 142 as shown. Thus the tools 140 and the spare vehicle equipment 142 are always readily available so that a person can work on a vehicle in the two level structure or on goods stored in the two level structure, with the maximum convenience and under conditions of heat and light if desired.

Figure 7:
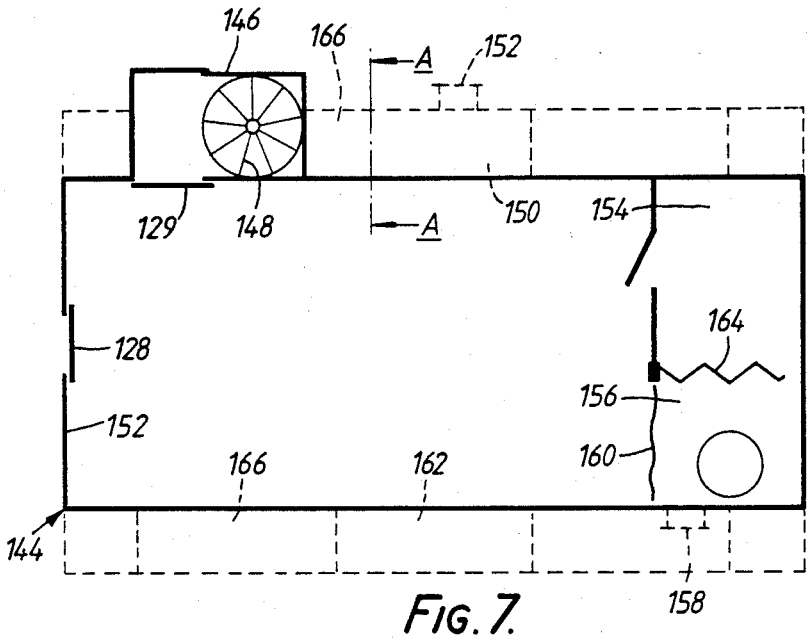
FIG. 7 is a somewhat schematic plan view of the layout of a pit for a two level structure, the pit also being constructed for use as a bomb shelter.
Figure 8:
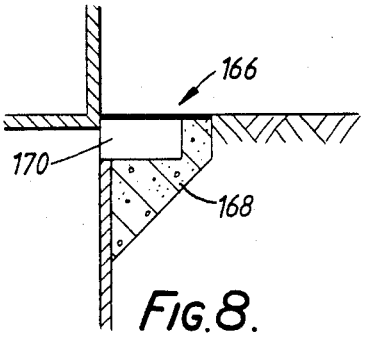
FIG. 8 is a section on the line AA shown in FIG. 7.

Referring to FIGS. 7 and 8, there is shown a possible structure for the auxillary chamber referred to in connection with FIG. 5. Thus, FIG. 7 shows an auxiliary chamber 144 having the emergency hatch 128 leading to the sunken pit having the end wall 76 and the floor 78. The hatch door 128 may also lead to an emergency exit 146 which may consist of a tower leading to ground level, the tower having a spiral staircase 148. The tower would of course by closed by an appropriate lid (not shown) and the lid would normally be secured by appropriate fastening means from inside.

The auxiliary chamber 144 may be provided with a ventilation unit 150 having an air inlet 152. Also provided may be a wash room 154, a lavatory 156, an air outlet 158, a plastic curtain 160, and a water supply tank 162. The wash room and lavatory may be separated by folding doors 164.

FIG. 8 is a section on the line AA shown in FIG. 7 and it illustrates how the peripheral edge 166 may be reinforced by reinforced concrete 168. The reinforced concrete 168 may be provided with a recessed portion 170 if desired.

It is to be appreciated that the embodiments of the invention described above with reference to the accompanying drawings have been given by way of example only and that modifications may be effected. Thus, for example, in FIGS. 1 to 4, the slit 74 could be for a key so that the control means 70 would then be key operated. Alternatively, the control means 70 may be operated by an electronic signal from a remote electronic signalling device. The jacks 12,14 may be replaced by piston and cylinder devices or by other types of mover means. One of the walls 20 is provided with a recess 171 for use in an emergency in the event that a person should be working in the pit underneath the first platform member 6, for example cleaning the bottom 18 of the pit 4. Usually, the first platform member 6 will be a relatively close fit in the pit 4 so that access to the bottom 18 of the pit 4 will usually be through a trap door 173 in the first platform.

In FIGS. 5 and 6, the positioning of the illustrated instruments can be varied. Similarly, in FIG. 7, the positioning of the various pieces of apparatus can also be varied so that, for example, the emergency exit 146 may be provided in the side wall 170 and the ventilation unit 150 may be provided in the end wall 152.

Advantageously, where the housing for the sunken pit is prefabricated, it is made in easily connectible parts so that the various parts can be stored and transported in a disconnected condition. Thus the disconnected parts may advantageously nest together in order to economise on space taken up.

If desired, the post 72 could be provided with a push button arrangement. The push button arrangement could be covered by a security cover which could be locked. When the security cover was unlocked, for example by a vehicle driver with a key, the driver could then push a desired button as in the operation of a lift.

I claim:

1. A two level structure for parking vehicles or storing goods, which structure comprises:

(i) a sunken pit;

(ii) first and second spaced apart platform members which are for receiving the vehicles or the goods;

(iii) support means which is mounted on the first platform member and which supports the second platform member in a fixed horizontal position above the first platform member;

(iv) an access hatch which is provided in the first platform member and which is for permitting access to the pit beneath the first platform member;

(v) mover means for moving the platform members from a first position in which the first platform member is in the pit and the second platform member is at ground level to a second position in which the first platform member is at ground level and the second platform member is above ground level;

(vi) a water sealing arrangement for preventing the ingress of water into the pit;

(vii) emergency stop means for automatically stopping the descent of the first and second platform members in the event that the second platform members encounters an obstacle;

(viii) a water drainage arrangement for draining water from the bottom of the pit;

(ix) a peripheral overlap portion which extends from the second platform member to overlap the rim of the pit and which is such that it is strong enough to withstand the weight of vehicles being parked running over it; and (x) ramp members which are positioned around the edges of the second platform member and which are pivotally attached to the second platform member in order to allow for variations in ground level over different parts of the ground around the rim of the pit;

the water sealing arrangement comprising an elongate seal provided on a lower surface of the overlap portion of the second platform member and spaced inwardly of a peripheral edge of said overlap portion, and a complementary elongate seal provided on the ground around the rim of the pit and spaced radially outwardly from the rim of the pit, the two seals being arranged to be in water-sealing cooperating registry when the second platform member is at ground level; and the emergency stop means comprising a pressure responsive spring biased electrical contact member which is provided on the overlap portion of the second platform member between the elongate seal and the rim of the pit, and a channel provided in the ground around the rim of the pit between the said complementary elongate seal and the rim of the pit, the pressure responsive spring biased electrical contact member being such that it normally locates in the channel and such that it operates to activate the emergency stop means if it is prevented by the obstacle from normally locating in the channel.

2. A two level structure according to claim 1 and including:

(xi) a first recess in a wall of the pit so that a person can escape into the recess in the event that the person should be working in the pit underneath the first platform member and the first platform member should start to descend; and (xii) a second recess in a wall of the pit for receiving tools and spare vehicle equipment.

3. A two level structure according to claim 2 and including:

(xiii) control means positioned above ground level for causing desired operation of the mover means to raise or lower the platform members;

(xiv) alarm means; and (xv) illumination means which is arranged to remain illuminated for a period of time after the first platform member has descended into the pit.

4. A two level structure according to claim 3 and including:

(xvi) a ventilation system;

(xvii) an auxiliary chamber which is constructed as a bomb shelter;

(xviii) an airtight door in the sunken pit for providing access to the auxiliary chamber;

(xix) an emergency exit leading from the pit to ground level which does not go through the pit;

(xx) water storage means;

(xxi) washing means; and (xxii) toilet means.

5. A two level structure according to claim 4 in which the mover means is a scissor jack arrangement; and in which controls for the two level structure are all mounted on an end wall of the pit.

* * * * *